US008234808B2

(12) United States Patent
Lewis et al.

(10) Patent No.: US 8,234,808 B2
(45) Date of Patent: Aug. 7, 2012

(54) MONOLITHIC RAIL PLATFORM AND BOLT ASSEMBLIES FOR A FIREARM

(75) Inventors: Karl R. Lewis, Moline, IL (US); James Arend Seabold Bargren, Moline, IL (US); Jacob A. Schafer, Rock Island, IL (US); Neal David Hohl, Orion, IL (US)

(73) Assignee: Karl R. Lewis, Moline, IL (US)

( * ) Notice: Subject to any disclaimer, the term of this patent is extended or adjusted under 35 U.S.C. 154(b) by 1192 days.

(21) Appl. No.: 10/513,254

(22) PCT Filed: May 12, 2003

(86) PCT No.: PCT/US03/15009

§ 371 (c)(1),
(2), (4) Date: Aug. 11, 2005

(87) PCT Pub. No.: WO03/095928

PCT Pub. Date: Nov. 20, 2003

(65) Prior Publication Data

US 2006/0236582 A1 Oct. 26, 2006

Related U.S. Application Data

(60) Provisional application No. 60/379,928, filed on May 10, 2002.

(51) Int. Cl.
*F41C 23/00* (2006.01)

(52) U.S. Cl. ..... 42/73; 42/71.01; 42/72; 42/75.03; 42/75.01; 42/75.02; 89/191.01

(58) Field of Classification Search ..... 42/73, 71.01, 42/72, 75.03, 75.01, 75.02; 89/191.01
See application file for complete search history.

(56) References Cited

U.S. PATENT DOCUMENTS

| | | | |
|---|---|---|---|
| 2,094,156 | A | 9/1937 | Johnson, Jr. |
| 2,146,743 | A | 2/1939 | Johnson, Jr. |
| 2,341,869 | A | 2/1944 | Johnson, Jr. |
| 2,383,487 | A | 8/1945 | Johnson, Jr. |
| 2,386,802 | A | 10/1945 | Johnson, Jr. |

(Continued)

FOREIGN PATENT DOCUMENTS

DE 93 04 489 U1 9/1993

(Continued)

OTHER PUBLICATIONS

C-More Systems, Quad Rail Handguard, Printed Publication—Dated Sep. 3, 2001.

(Continued)

*Primary Examiner* — Michelle Clement
(74) *Attorney, Agent, or Firm* — Woodard, Emhardt, Moriarty, McNett & Henry LLP

(57) ABSTRACT

A firearm assembly for a firearm can include a monolithic rail platform with a handguard portion and an upper receiver portion. The barrel of the firearm can be positioned through the handguard portion and secured with the upper receiver portion. A firearm assembly can also include a bolt assembly with a bolt carrier having minimized land area and a forward end sized for receipt in the barrel extension at the rearward end of the barrel.

54 Claims, 8 Drawing Sheets

U.S. PATENT DOCUMENTS 2,400,422 A * 5/1946 Johnson, Jr ..... 42/71.01
2,409,568 A 10/1946 Johnson, Jr.
2,409,569 A 10/1946 Johnson, Jr.
2,437,137 A 3/1948 Swebilius
2,481,548 A 9/1949 Waltke, Jr.
2,484,444 A 10/1949 Benson
2,950,653 A 8/1960 Harvey
2,951,424 A 9/1960 Stoner
3,075,314 A 1/1963 Bakker
3,090,150 A 5/1963 Stoner
3,198,076 A 8/1965 Stoner
3,380,183 A * 4/1968 Sullivan et. al. ..... 42/75.02
3,507,187 A 4/1970 Maillard
3,690,218 A 9/1972 Maillard
3,731,418 A * 5/1973 Birkenhagen et al. ..... 42/75.02
3,742,638 A 7/1973 Archer
3,834,053 A 9/1974 Bielfeldt et al.
3,883,977 A 5/1975 McClure
3,939,589 A 2/1976 Tellie
3,979,849 A 9/1976 Haskins
4,058,922 A 11/1977 Elbe et al.
4,272,902 A 6/1981 Waters
4,398,448 A * 8/1983 LaFever ..... 89/185
4,433,610 A 2/1984 Tatro
4,536,982 A 8/1985 Bredbury et al.
4,553,469 A * 11/1985 Atchisson ..... 89/191.02
4,579,034 A 4/1986 Holloway
4,653,210 A 3/1987 Poff, Jr.
4,655,118 A 4/1987 Bruderer et al.
4,663,875 A 5/1987 Tatro
4,765,224 A 8/1988 Morris
4,769,938 A 9/1988 Chesnut et al.
4,891,898 A 1/1990 Houseman
4,942,802 A 7/1990 Stoner
4,944,109 A 7/1990 Zedrosser
5,010,676 A 4/1991 Kennedy
5,142,806 A 9/1992 Swan
5,155,284 A * 10/1992 Flashkes ..... 42/75.02
5,198,600 A 3/1993 E'Nama
5,343,650 A 9/1994 Swan
5,351,598 A 10/1994 Schuetz
5,448,940 A 9/1995 Schuetz et al.
5,513,461 A 5/1996 Weldle
5,540,008 A 7/1996 Kirnstatter
5,551,179 A * 9/1996 Young ..... 42/16
5,590,484 A 1/1997 Mooney et al.
5,689,908 A 11/1997 Brandl
5,726,375 A 3/1998 Adams et al.
5,826,363 A 10/1998 Olson
5,881,486 A 3/1999 Bilgeri et al.
5,900,577 A * 5/1999 Robinson et al. ..... 89/191.01
5,911,173 A 6/1999 Westrom
5,974,716 A 11/1999 Kidd
6,044,748 A * 4/2000 Westrom ..... 89/185
6,182,389 B1 * 2/2001 Lewis ..... 42/16
6,250,194 B1 6/2001 Brandl et al.
6,490,822 B1 12/2002 Swan
6,499,246 B1 * 12/2002 Zedrosser ..... 42/75.03
6,508,027 B1 * 1/2003 Kim ..... 42/124
6,564,491 B2 * 5/2003 Murello ..... 42/16
6,609,319 B1 * 8/2003 Olson ..... 42/16
6,671,990 B1 1/2004 Booth
6,694,660 B1 * 2/2004 Davies ..... 42/75.01
6,722,255 B2 4/2004 Herring
6,739,082 B2 * 5/2004 Christensen ..... 42/6
6,752,137 B2 6/2004 Brunette et al.
6,839,998 B1 * 1/2005 Armstrong ..... 42/71.01
6,848,351 B1 * 2/2005 Davies ..... 89/191.01
7,000,345 B1 2/2006 Kay
7,059,076 B2 * 6/2006 Stoner et al. ..... 42/75.01
7,131,228 B2 * 11/2006 Hochstrate et al. ..... 42/75.01
RE39,465 E * 1/2007 Swan ..... 42/71.01
7,213,498 B1 * 5/2007 Davies ..... 89/198
7,216,451 B1 * 5/2007 Troy ..... 42/72
7,231,861 B1 * 6/2007 Gauny et al. ..... 89/1.4
7,316,091 B1 * 1/2008 Desomma ..... 42/16
7,581,954 B2 9/2009 Schavone
7,810,271 B2 10/2010 Patel
7,827,722 B1 11/2010 Davies
2002/0046478 A1 * 4/2002 Murello ..... 42/16
2005/0262750 A1 * 12/2005 Olson et al. ..... 42/7
2005/0262752 A1 * 12/2005 Robinson et al. ..... 42/71.01
2006/0065112 A1 3/2006 Kuczynko et al.
2008/0216375 A1 9/2008 Barrett
2009/0288324 A1 11/2009 Peterson et al.
2010/0212201 A1 8/2010 Kincel et al.
2010/0229445 A1 9/2010 Patel

FOREIGN PATENT DOCUMENTS

DE 196 13 421 C2 7/2000

OTHER PUBLICATIONS

Statement of New Questions of Patentability—Filed Dec. 1, 2006 for U.S. Patent No. 6,694,660 assigned U.S. Appl. No. 90/006,357.
*Fitting the Olympic Arms FIRSH Handguard to a Military Issue M-16A2 Rifle*, Printed Publication, unknown publication date. Available at: http://www.olyarms.com/index.php?option=com_docman &task=cat_view&gid=37&Itemid=.
Armalite, Inc.—*Technical Note 9: Installation of Armalite Fiberglass Handguard*, Printed publication dated Aug. 28, 1997.
Badger Ordnance, Stabilizer Handguard, unknown publication date.
Patrick A. Rogers, *The Monolithic Rail Platform Carbine, SWAT Magazine*, Oct./Nov. 2004 at 4 and 52-57.
Ben Battles, *AR Report: Lewis Machine & Tool Monolithic Rail Platform, Shedding New Light on the "Black Rifle*," On Target, Sep. 2005 at 20-21.
Gary Paul Johnston, *The Monolithic Rail Platform: Finally a Quick-Change Barrel System for the M16!*, Soldier of Fortune Magazine, Sep. 2004 at 48-57.
M-16 Rifle Fact File for the United States Army (http://www.army.mil/factfiles/equipment/individual/m16.html) Apr. 10, 2011.
Colt Weapon Systems (http://www.colt.com/milM16.asp) Apr. 10, 2011.
M16-definition of M16 (http://www.thefreedictionary.com/M16) Apr. 10, 2011.
Wikipedia, M16 rifle (http://www.wikipedia.org/wiki/M16_rifle) Apr. 10, 2011.
Non-Final Office Action received in related Application, U.S. Appl. No. 12/872,065 mailed Apr. 18, 2011.
Auto Trans of DE19613421 from ESPANET.
Photograph of a Sten http://img173.imageshack.us/img173/6386/stenmk36pe.jpg.
Comparison of Sten MK I, MK II and MK III http://www.prexis.com/sten/STEN%20PART%20DIFFERENCES.pdf.
Schematic diagram of Sten MK II http://stenmkiii.tripod.com/sitebuildercontent/sitebuilderfiles/stenmkii.pdf.

* cited by examiner

MONOLITHIC RAIL PLATFORM AND BOLT ASSEMBLIES FOR A FIREARM

CROSS-REFERENCE TO RELATED APPLICATIONS

This application is a National Stage of International Application No. PCT/US2003/15009, filed May 12, 2003. PCT/US2003/15009 claims the benefit of U.S. Provisional Application No. 60/379,928, filed May 10, 2002.

BACKGROUND

The use of automatic and semi-automatic rifles is commonly known to be prevalent in the military. Such weapons typically employ an upper receiver and bolt action operating system. One standard weapon for the U.S. Military is the M-16 rifle. Semi-automatic rifles such as the AR15 type are used in the civilian sector. Such rifles can be further adapted for single shot action. The structure and mechanisms of semi-automatic and automatic rifles have been the subject of much refinement and variation over the years.

While there have been advances in the designs of prior art rifles, there remains room for additional improvements. The present invention is directed toward providing various improvements to semi-automatic and automatic rifles.

SUMMARY

The present invention is directed to monolithic rail plate platforms and bolt assemblies for rifles.

According to one aspect, there is provided a monolithic rail platform that includes a handguard portion and an upper receiver portion integrally formed with one another as a single component.

According to another aspect, there is provided an improved bolt carrier for a semi-automatic or automatic rifle.

According to a further aspect, there is provided an improved operating system for a semi-automatic or automatic rifle.

According to yet another aspect, there is provided an improved rifle assembly for attachment of peripheral components thereto.

These and other aspects will also be apparent from the following description of the illustrated embodiments.

DESCRIPTION OF THE ILLUSTRATED EMBODIMENTS

Figure 1:
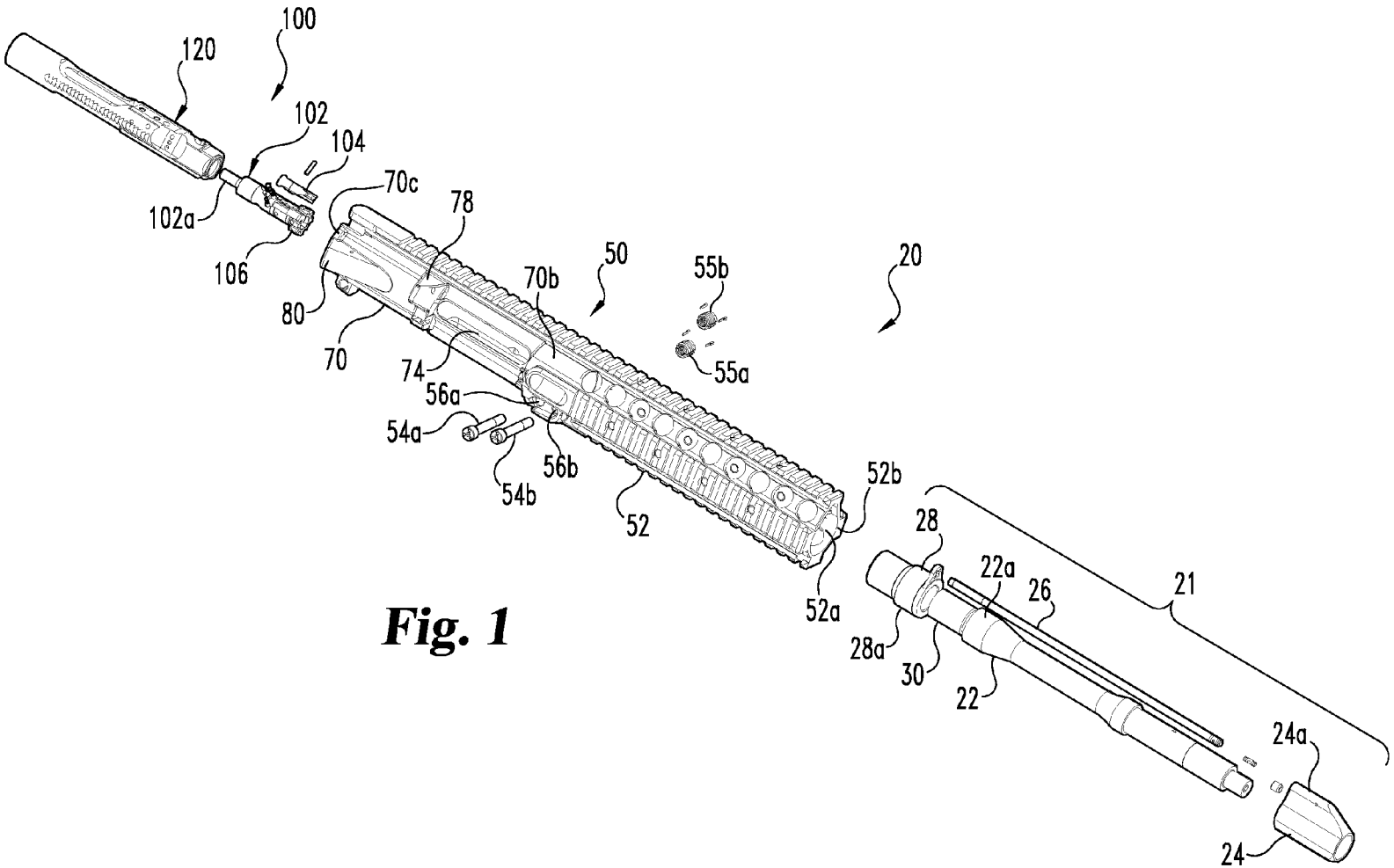
FIG. 1 is an exploded view of an upper portion of a firearm.
Figure 2:
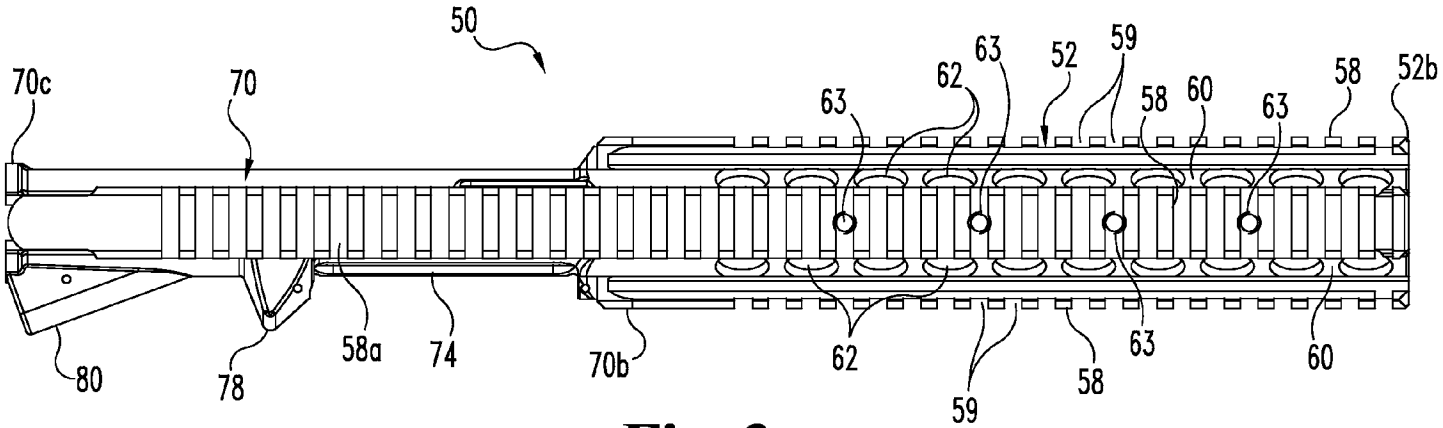
FIG. 2 is a top view of an monolithic rail platform comprising the upper portion of FIG. 1.
Figure 3:
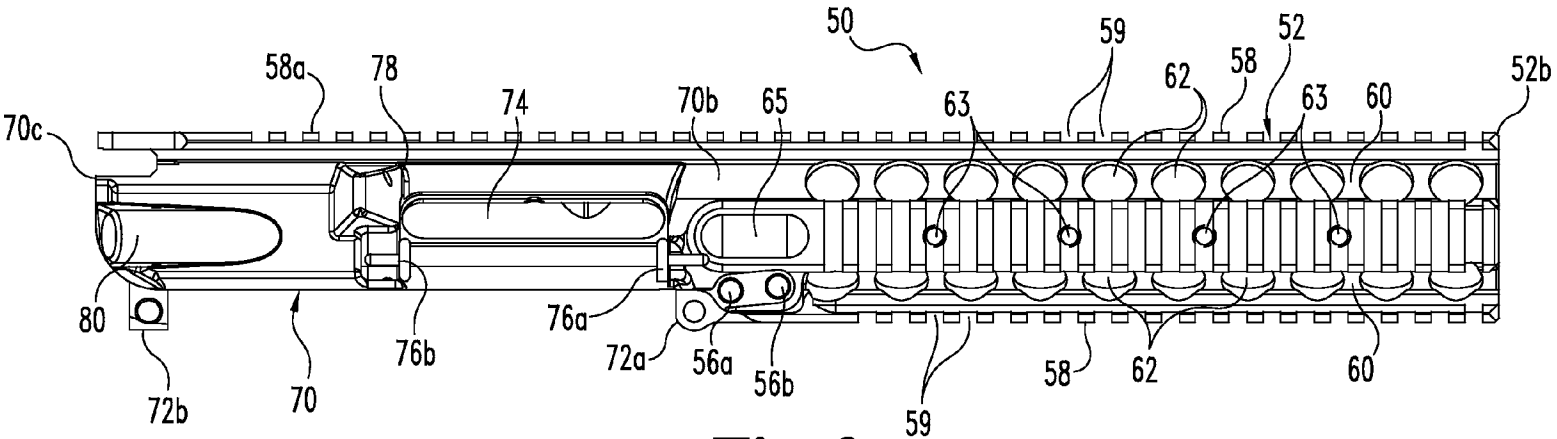
FIG. 3 is a side view of the monolithic rail platform of FIG. 2.
Figure 4:
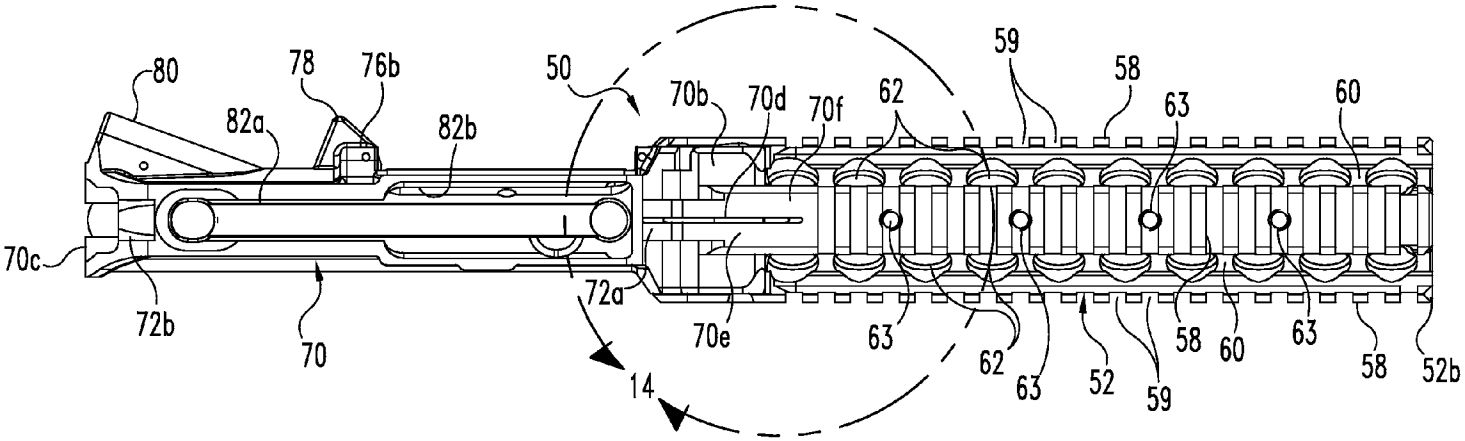
FIG. 4 is a bottom view of the monolithic rail platform of FIG. 2.
Figure 5:
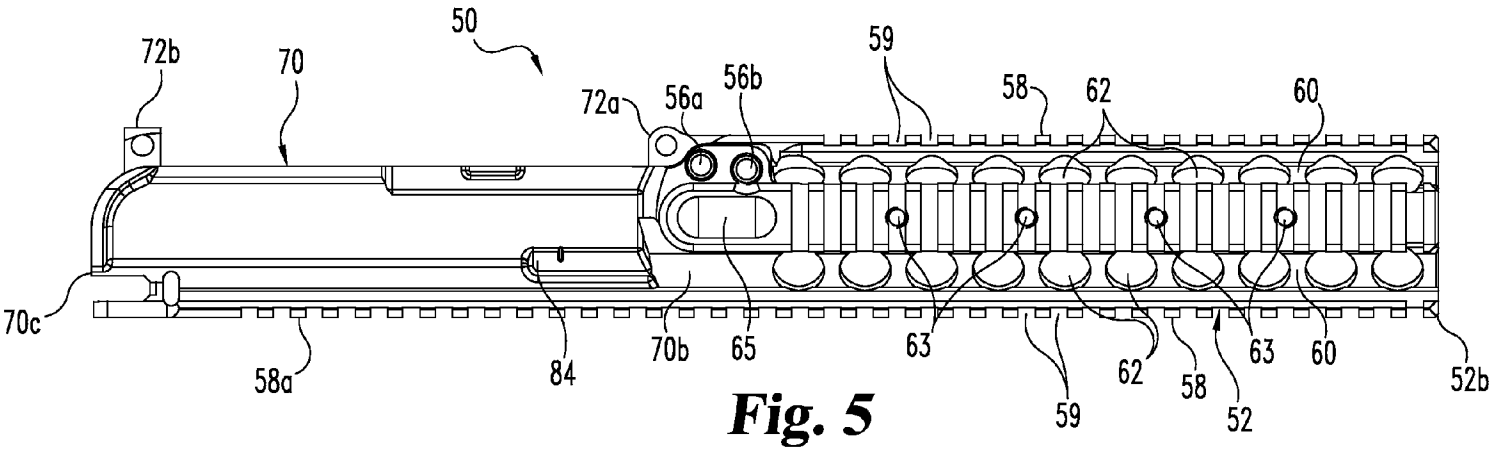
FIG. 5 is an inverted side view of the monolithic rail platform of FIG. 2 looking at the side opposite the side shown in FIG. 3.
Figure 7:
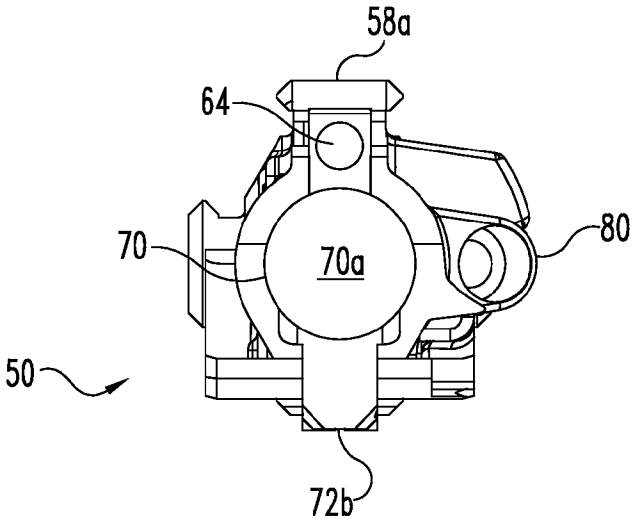
FIG. 7 is a left end view of the monolithic rail platform of FIG. 2.
Figure 6:
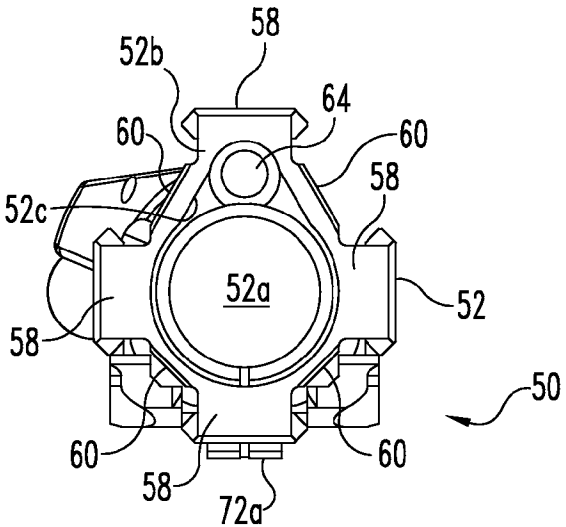
FIG. 6 is a right end view of the monolithic rail platform of FIG. 2.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any such alterations and further modifications in the illustrated device, and any such further applications of the principles of the invention as illustrated herein are contemplated as would normally occur to one skilled in the art to which the invention relates.

An assembly 20 for an upper portion of a firearm is shown in FIG. 1 in an exploded view. The lower receiver assembly, butt stock and magazine are not shown in FIG. 1, it being understood that the lower receiver, butt stock and magazine can be provided in any configuration suitable for an automatic M16/AR15 type rifle or any other rotating bolt type rifle or any other type or caliber rifle. Assembly 20 includes a barrel assembly 21 that includes a barrel 22 having a gas block 24 attachable to a forward end thereof. A gas tube 26 extends rearwardly from gas block 24 to the upper receiver. A barrel extension 28 is attachable to the rearward end of barrel 22 adjacent cartridge chamber 30. Barrel extension 28 is configured to interlock with the bolt, such as bolt 102. Further details regarding one embodiment bolt 102 and barrel extension 128 are provided in U.S. Pat. No. 6,182,389, which is incorporated herein by reference in its entirety. Assembly 20 further includes an upper receiver assembly 50 that includes a handguard portion 52 integrally formed with an upper receiver portion 70.

Figure 14:
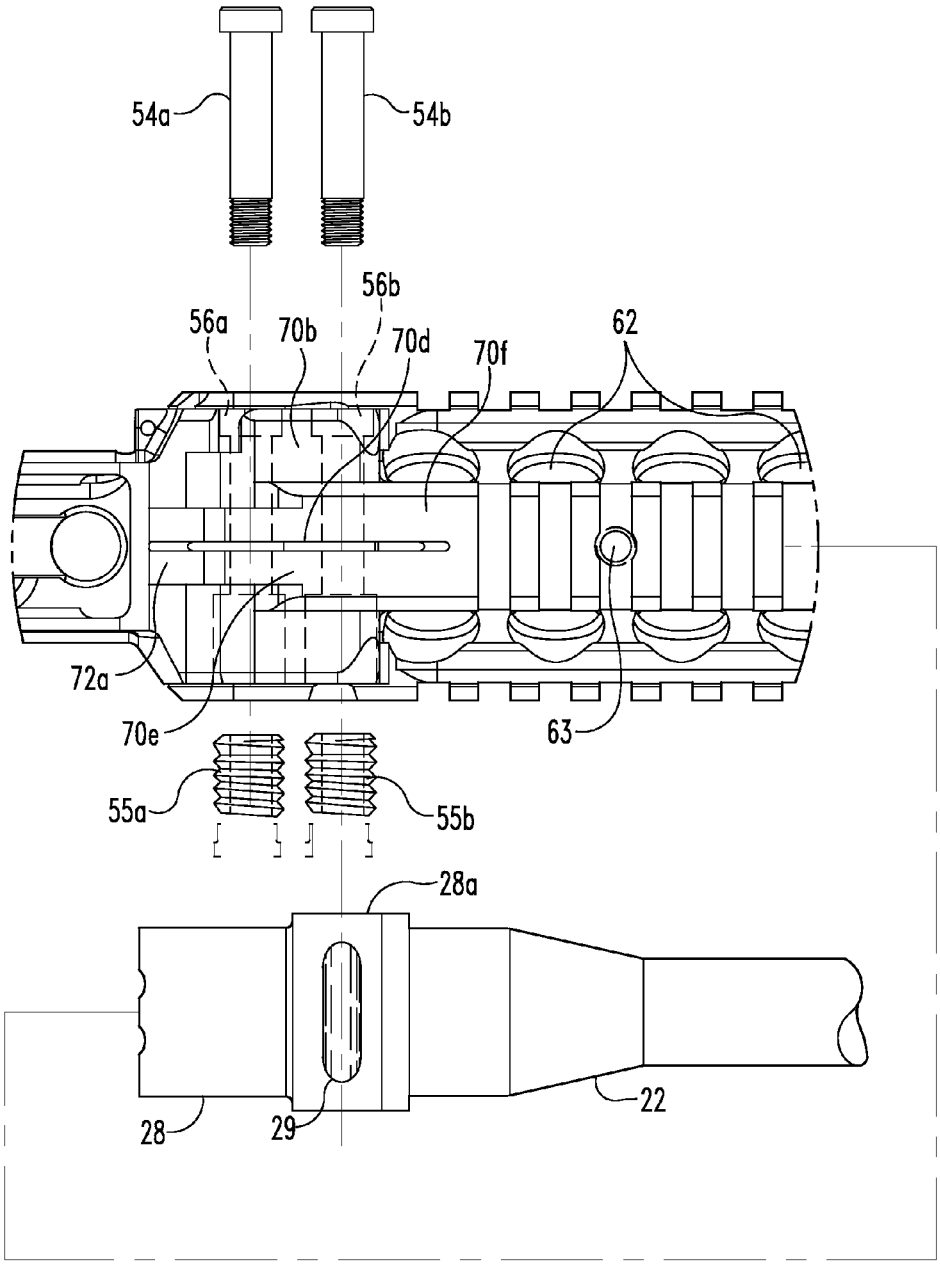
FIG. 14 a bottom view of section 14 of the monolithic rail platform of FIG. 2 shown in a partial assembly view with barrel assembly 21 of FIG. 1.

Referring now further to FIGS. 2-7 and 14, when assembly 20 is assembled, a bolt carrier 120 housing bolt 102 is positioned in and movably received along the longitudinal axis of bore 70*a* of upper receiver portion 70, and barrel assembly 21 is positioned in bore 52*a* of handguard portion 52. Barrel assembly 21 is secured to monolithic rail platform 50 with fasteners 54*a*, 54*b* and clamping nuts 55*a*, 55*b*. Fasteners 54*a*, 54*b* extend through respective ones of the holes 56*a*, 56*b* through monolithic rail platform 50. Clamping nuts 55*a*, 55*b* are coupled to the threaded ends of fasteners 54*a*, 54*b* to clamp monolithic rail platform 50 around enlarged portion 28*a* of barrel extension 28 on barrel 22 at the forward end of upper receiver portion 70. It is further contemplated that fastener 54*b* can act as a locating and retaining pin by interacting with enlarged portion 28*a* of barrel extension 28 to ensure that barrel 22 is properly positioned and located in monolithic rail platform 50. For example, fastener 54*b* can be received in recess 29 formed in an outer surface of enlarged portion 28*a* of barrel extension 28 when barrel 22 is at the proper locating in bore 52*a* of handguard portion 52 as depicted in FIG. 14. Fastener 54*b* in recess 29 can resist any forward movement of barrel 22 and barrel extension 28 that might be created by contact of the bolt carrier therewith.

Handguard portion 52 includes a number of rails 58 extending therealong separated by recesses 60 therebetween. Rails 58 include transverse grooves 59 formed therein to facilitate gripping of handguard portion 52. A number of threaded holes 63 are spaced along each rail 58 to allow attachment of peripheral devices, such as a grenade launcher, site, sling and/or scope, for example. Recesses 60 each include a number of holes 62 formed therein along handguard portion 52 to allow air flow and heat from barrel 22 to vent therethrough.

Handguard portion 52 further includes a rearward extension 58*a* for the upper rail 58 that extends along upper receiver portion 70. The rearward extension 58*a* includes a passage 64 formed therethrough that communicates gas tube 26 to provide a path for delivering gas to the operating system of the rifle. The forward end 52*b* of handguard portion 52 includes a triangular shaped opening 52*c* adapted to receive the upper extension 24*a* of gas block 24. Gas tube 26 is coupled to upper extension 24*a* of gas block 24.

Upper receiver portion 70 includes a forward end 70*b* integrally formed with handguard portion 52 and a rearward end 70*c*. Forward end 70*b* can comprise a clamping portion having clamping members 70*e*, 70*f* positioned on opposite sides of slot 70*d* to facilitate clamping of upper receiver portion 70 about barrel 22. A cut-out 65 is formed in forward end 70*b* to reduce weight. Upper receiver portion 70 further includes a forward lug 72*a* and a rearward lug 72*b* extending downwardly from a bottom side thereof. The lower receiver assembly (not shown) is attachable to lugs 72*a*, 72*b*. Upper receiver portion 70 further includes ejection port opening 74 and ejection port cover receptacles 76*a*, 76*b* on opposite sides thereof. Ejection port receptacles 76*a*, 76*b* receive pins that pivotally couple an ejection port cover (not shown) over opening 74. A deflector 78 extends outwardly from upper receiver portion 70 adjacent the rearward end of ejection portion opening 74 to deflect ejected cartridges away from the shooter. Upper receiver portion 70 further includes a forward assist port 80 that receives a forward assist mechanism (not shown) to assist in positioning the bolt carrier assembly 100 in its forward battery position in upper receiver portion 70 if needed.

Opposite ejection port receptacle 74 there is a lip of material 84 to support a cam pin cut-out in the upper receiver portion 70. Upper receiver portion 70 further includes in the bottom side thereof a first opening 82*a* along a rearward portion thereof for receiving the trigger assembly of the lower receiver assembly. Upper receiver portion 70 also includes a second opening 82*b* along a forward portion thereof communicating with the magazine receptacle of the lower receiver assembly for receiving cartridges therethrough from the magazine of the rifle. Second opening 82*b* is wider than first opening 82*a* and first and second openings 82*a*, 82*b* are in communication with one another along the bottom portion of upper receiver portion 70. The rearward end 70*c* of upper receiver portion 70 is positionable adjacent the lower receiver extension assembly and buttstock assembly of the lower receiver assembly when the rifle is assembled.

With barrel 22 secured to the coupling portion at forward end 70*b* of upper receiver portion 70, handguard portion 52 can extend around barrel 22, but need not be supported by, or in contact with, or coupled to barrel 22. Accordingly, barrel 22 can float in bore 52*a* of handguard portion 52. Monolithic rail platform 50 allows the hoop strength of handguard portion 52 to be maximized since, in one embodiment, it is provided as a single continuous ring extending along barrel 22. The integral unitary construction of upper receiver portion 70 and handguard portion 52 provide a stronger, reliable rifle assembly since there are fewer parts that require assembly. Peripheral devices, such as scope mounts, sites, slings, and grenade launchers, for example, that are mounted on handguard portion 52 do not apply load on or influence barrel 22, improving rifle accuracy. Rather, such loads and other influences created by these peripherals are transmitted from handguard portion 52 to upper receiver portion 70. Furthermore, in one embodiment, any threaded connection between barrel 22 and upper receiver portion 70 is eliminated, allowing rapid attachment and detachment of barrel 22 via fasteners 54*a*, 54*b*. The integral upper receiver and handguard portions and means of attaching the barrel allow for rapid assembly and disassembly of rifle components, which can be critical in the field.

Referring now to FIGS. 8-13, further details regarding bolt carrier 120 of bolt assembly 100 will be provided. Bolt carrier 120 includes a forward end 120*a* and an opposite rearward end 120*b*. Forward end 120*a* is oriented toward barrel 22 when bolt carrier 120 is positioned in upper receiver portion 70. A passage 120*d* extends between forward end 120*a* and rearward end 120*b* along a longitudinal axis of bolt carrier 120. Passage 120*d* has a minimum diameter portion 120*c* sized to receive the reduced diameter end portion 102*a* of bolt 102 when positioned therein. Passage 120*d* further includes a bolt receiving portion 120*e* extending forwardly from minimum diameter portion 120*c* to forward end 120*a* to receive the remaining portion of bolt 102. Bolt 102 is mounted in bolt carrier 120 for axial sliding movement in forward portion 120*e*. Bolt 102 includes a cartridge extractor 104 pivotally coupled thereto, and includes lugs 106 at the forward end thereof that releasably interlock with barrel extension 28. A firing pin (not shown) extends through a central bore through bolt 102. A cam slot 124 is formed adjacent forward end 120*a* which receives a cam member therethrough for contacting bolt 102 to rotate it as it moves rearwardly and forwardly for engagement with barrel extension 28.

Figure 8:
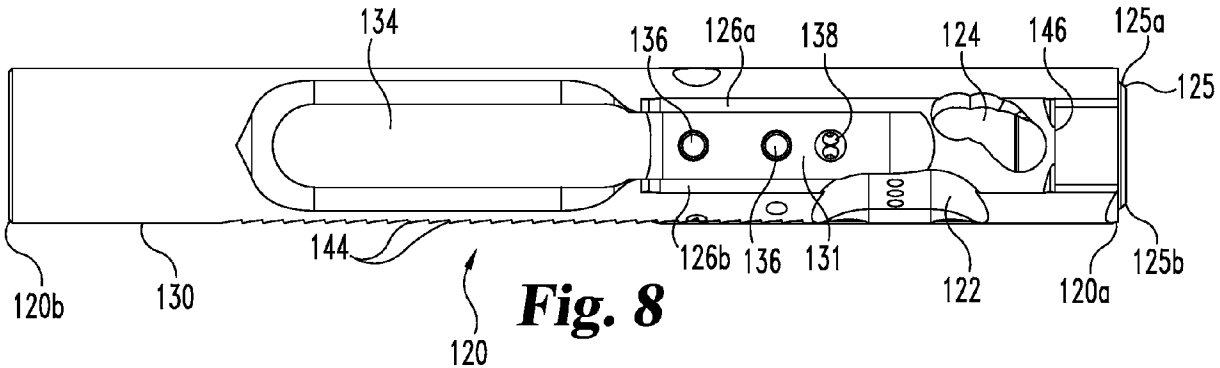
FIG. 8 is a top view of a bolt carrier comprising a portion of the upper portion of FIG. 1.
Figure 9:
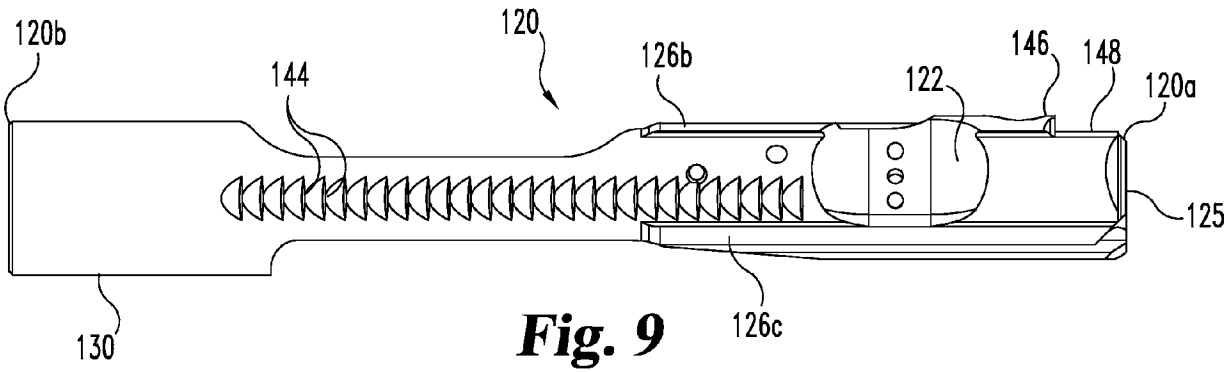
FIG. 9 is a side view of the bolt carrier of FIG. 8.
Figure 10:
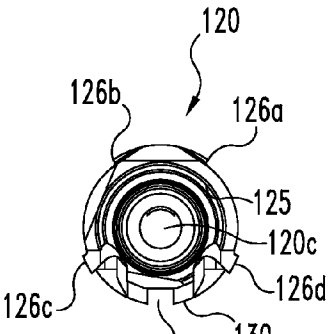
FIG. 10 is a right end view of the bolt carrier of FIG. 8.
Figure 11:
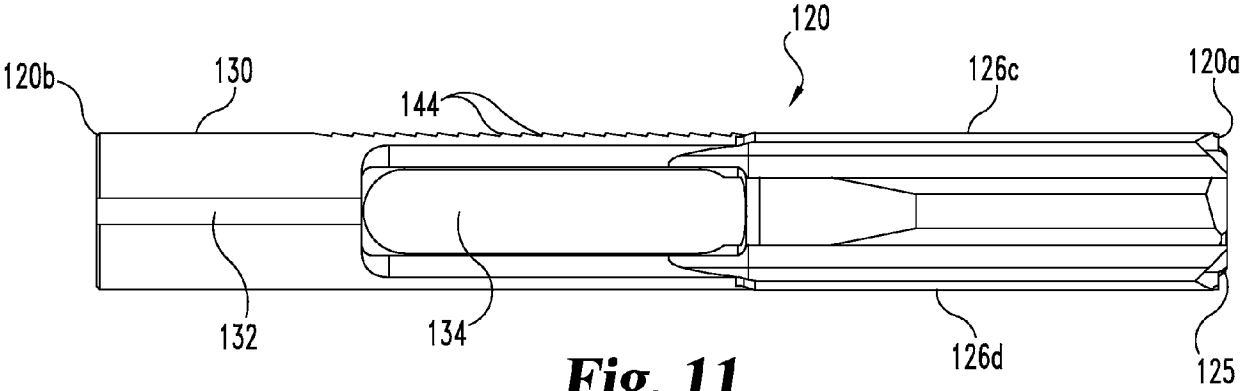
FIG. 11 is a bottom view of the bolt carrier of FIG. 8.
Figure 13:
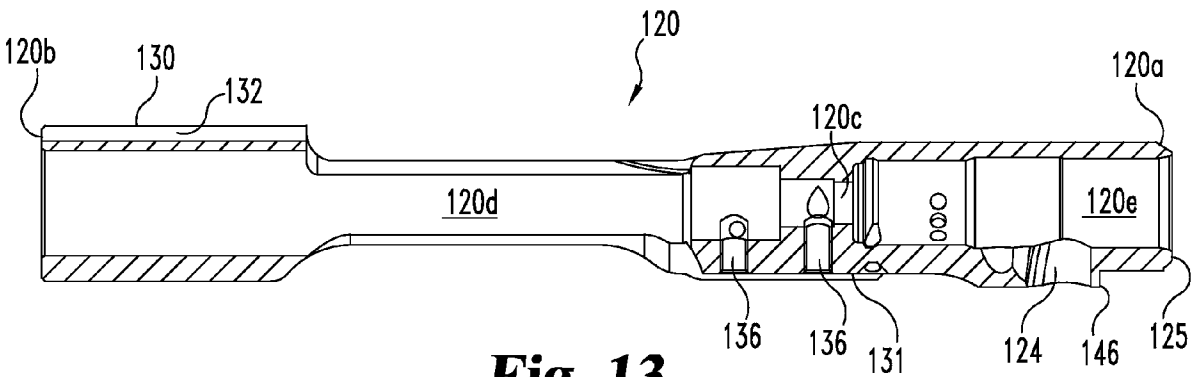
FIG. 13 is a section view through line 13-13 of FIG. 12.
Figure 12:
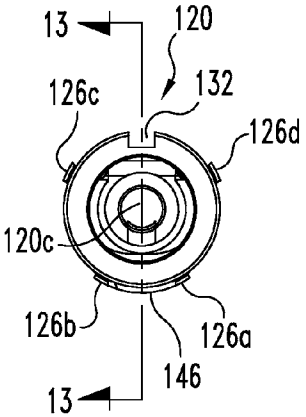
FIG. 12 is a left end view of the bolt carrier of FIG. 8 as oriented in FIG. 11.
Figure 15:
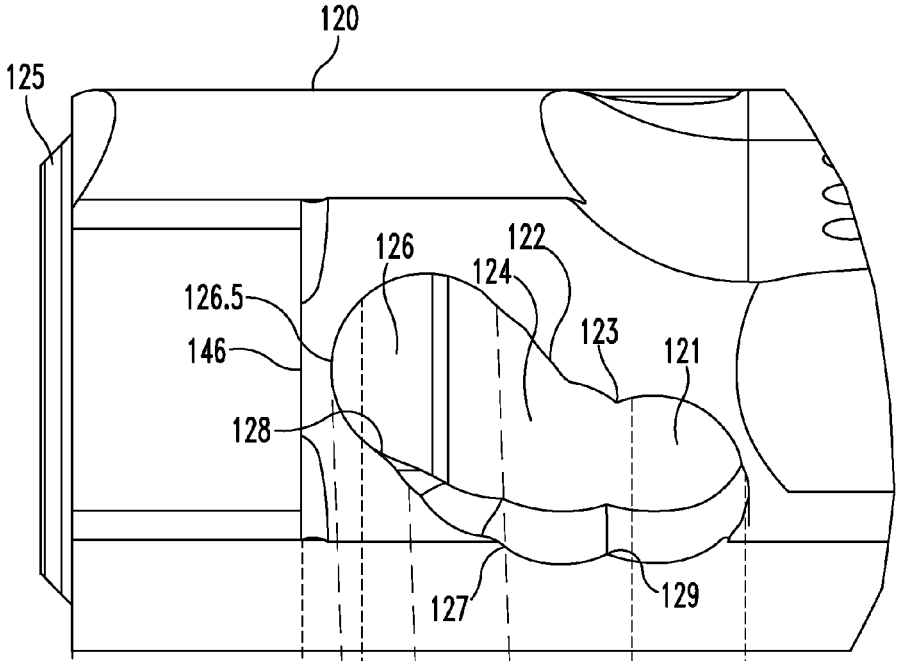
FIG. 15 is a close up view of the front end of bolt carrier 120 shown in FIG. 8.

Referring now to FIG. 15, a close up view of the front end of bolt carrier 120 illustrated in FIG. 8 is shown illustrating cam slot 124. Cam slot 124 includes locked position 121, unlocked position 126, forward edge 126.5, unlocking cam path 127, delay ridge 128, end of unlock dwell 129, locking cam path 122 and delay ridge 123. Locked position 121 is the approximate position of the cam member when bolt 102 is locked in engagement with barrel extension 28. Unlocked position 126 is the approximate position of the cam member during extraction and reloading when bolt 102 is unlocked from barrel extension 28. Unlocking cam path 127 is the surface that the cam member slides across as bolt carrier 120 moves rearwardly with respect to bolt 102 thereby unlocking bolt 102 from barrel extension 28. Delay ridge 128 provides a small hitch in unlocking cam path 127 prior to the cam member reaching unlocked position 126. End of unlock dwell 129 is the end of strictly longitudinal movement of the cam member and bolt 102, afterwards rotation to unlock bolt 102 from barrel extension 28 begins. Locking cam path 122 is the surface that the cam member slides across as bolt carrier 120 moves forwardly with respect to bolt 102 while bolt 102 engages with and locks into barrel extension 28. Delay ridge 123 provides a small hitch in locking cam path prior to the cam member reaching locked position 121.

Figure 16:
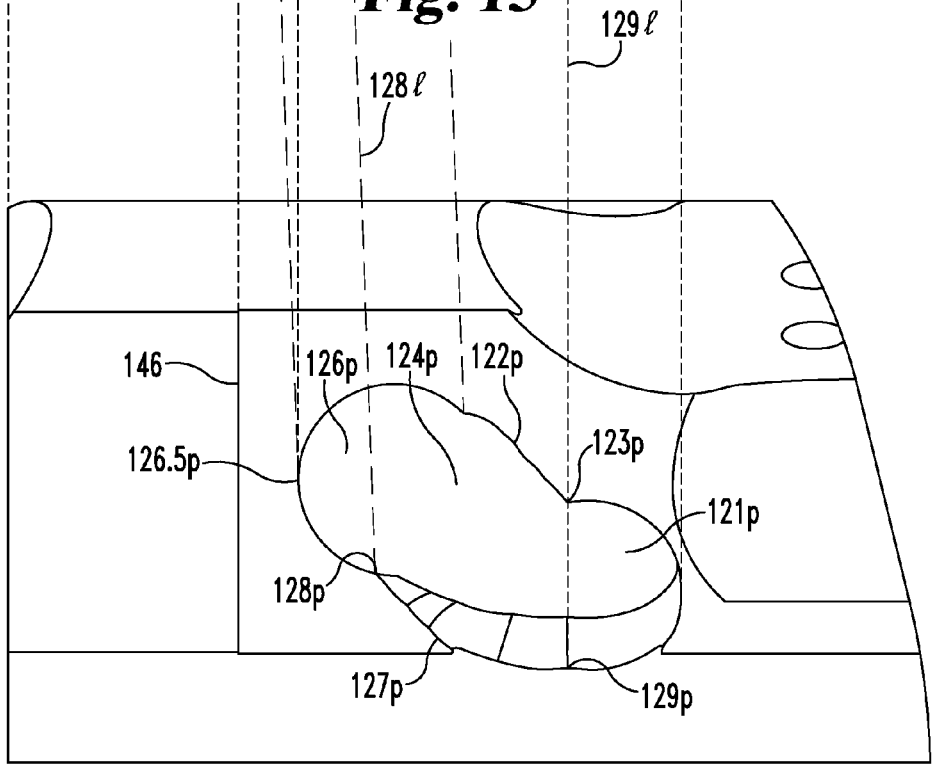
Fig. 16 (PRIOR ART)
FIG. 16 is a close up view of the front end of a prior art M-16 bolt carrier.

Referring now to FIG. 16, a close up view of the front end of a prior art M-16 bolt carrier is illustrated in the same scale as and aligned with FIG. 15. FIG. 16 illustrates prior art cam slot 124*p* which includes locked position 121*p*, unlocked position 126*p*, forward edge 126.5*p*, unlocking cam path 127*p*, delay ridge 128*p*, end of unlock dwell 129*p*, locking cam path 122*p* and delay ridge 123*p*, each of which, while differently shaped, perform the same functions described above with regard to comparable features of cam slot 124. Also shown are lines 128*l* and 129*l* between cam slot 124*p* and cam slot 124. Line 128*l* originates at delay ridge 128*p* and extends up toward FIG. 15 at an angle equal to a line between forward edge 126.5 and forward edge 126.5*p*. Line 129*l* extends up from end of unlock dwell 129*p*.

Comparing cam slot 124 with cam slot 124*p*, note that forward edge 126.5 is closer to charging handle contact portion 146 than forward edge 126.5*p* by approximately the depth of protrusion 125 (approximately 0.100"). Similarly, end of unlock dwell 129 is positioned more forward than end of unlock dwell 129*p* by approximately the depth of protrusion 125. This provides the previously discussed increase in the dwell time of bolt 102 prior to extraction which allows more time to vent residual gas pressure in barrel 22 prior to unlocking bolt 102 from barrel extension 28. Finally, delay ridge 128 is substantially removed from cam slot 124 as it is substantially less prominent and more forward compared to delay ridge 128*p*.

Bolt carrier 120 includes a slot 134 therethrough that receives the hammer from the lower receiver assembly to strike the firing pin in bolt 102. Bolt carrier 120 further includes gas key mounting holes 136 formed in an upper mounting surface 131 of bolt carrier 120. Gas key mounting holes 136 communicate with passage 120*d*. A gas port 138 is further provided in mounting surface 131 and includes ports extending therefrom in communication with passage 120*d*. One side of bolt carrier 120 is provided with forward assist notches 144 which are engageable by a forward assist mechanism (not shown) in forward assist port 80 of upper receiver portion 70. Bolt carrier 120 further includes a door opener 122 that is recessed in the body of bolt carrier 120 to provide room for the door latch to close. Bolt carrier 120 includes a charging handle contact portion 146 adjacent forward end 120*a*.

Rearward end portion 130 includes a groove 132 cut therein along the longitudinal axis of bolt carrier 120 to maintain alignment of bolt carrier 120 as it axially reciprocates in upper receiver portion 70. Bolt carrier 120 further includes forward lands 126*a*, 126*b*, 126*c*, and 126*d* extending along the forward half of bolt carrier 120. Lands 126*a*, 126*b* extend along the upper portion of bolt carrier 120 along mounting surface 131 and terminate at contact portion 146. Lands 126*c* and 126*d* extend along the bottom portion of bolt carrier 120 and terminate at forward end 120*a*. The lands 126*a*, 126*b* 126*c*, 126*d* contact the inner wall of bore 70*a* of upper receiver portion 70 to maintain alignment of bolt carrier 120 centrally therein and also in alignment with the centerline of barrel 22. The land area along bolt carrier 120 and also along forward end portion 148 is minimized by reducing the land area in the range from one-half to one twenty-fifth of that of prior art bolt carriers.

The portion of bolt carrier 120 along which each of the lands 126*a*, 126*b*, 126*c*, 126*d* extends has a surface area, and lands 126*a*, 126*b*, 126*c*, 126*d* occupy a portion of that surface area. In one embodiment, a section of bolt carrier 120 including lands 126*a*, 126*b*, 126*c*, 126*d* occupies a surface area that ranges from 1% to 12% of the surface area of the occupied portion of the bolt carrier 120. In another embodiment, lands 126*a*, 126*b*, 126*c*, 126*d* occupy a surface area that ranges from 1% to 8% of the surface area of the occupied portion of the bolt carrier. In another embodiment, lands 126*a*, 126*b*, 126*c*, 126*d* occupy a surface area that ranges from 1% to 4% of the surface area of the occupied portion of the bolt carrier.

By minimizing the land area, the contact surface area between bolt 120 and the wall of bore 70*a* of upper receiver portion 70. This allows greater ease of movement of bolt carrier 120 in upper receiver portion 70. The reduced contact area also provides greater clearance between bolt carrier 120 and any particles in bore 70*a* of upper receiver portion 70, allowing bolt carrier 120 to deposit such particles and debris in the recessed areas between the lands to provide a self-cleaning action that reduces malfunction in harsh environments and with prolonged usage.

The protrusion 125 at the forward end of bolt carrier 120 is sized for receipt in the rearwardly facing opening of barrel extension 28. Protrusion 125 is positioned radially inwardly from the outer perimeter of forward end 120*a*, and includes a sloped or chamfered outer surface that extends from a first diameter at rearward end 125*b* adjacent forward end 120*a* to a reduced diameter forward face 125*b* at the forward end of protrusion 125. Bore 120*d* extends through protrusion 125. Protrusion 125 allows bolt carrier 120 to be positioned more forwardly in upper receiver portion 70 as compared to a bolt carrier having the same overall length without protrusion 125. By positioning bolt carrier 120 more forwardly in upper receiver portion 70, the time required to move bolt carrier 120 rearwardly to turn bolt 102 is increased. Protrusion 125 thus increases the stroke length for bolt carrier 120 in upper receiver portion 70. The additional stroke length provided by protrusion 125 increases the dwell time of bolt 102 in barrel extension 28, allowing residual gas pressure in barrel 22 more time to vent before bolt 102 unlocks with barrel extension 28.

In one embodiment, protrusion 125 is sized to extend forwardly a distance of one hundred thousandths of an inch to increase the dwell time of bolt 102 by up to two times that provided in bolt carriers without protrusion 125. It is contemplated that other embodiments may provide other lengths and/or other dwell times associated with protrusion 125. The reduced gas pressure in the blowback operation reduces the load exerted on extractor 104 during the extraction cycle, improving system operation in the extraction and ejection cycles for the spent cartridge. For example, by venting additional gas pressure before extraction, expansion of the spent cartridge casing is reduced facilitating extraction and reducing the extraction loading. The load and forces exerted on bolt 102, barrel extension 28, and upper receiver portion 70 are reduced. Thus, rather than having excess energy from the gas pressure consumed in the recoil cycle, more energy is directed for use in the counter recoil cycle and feeding and chambering of cartridges. The increased stroke length thus increases overall system operability, reliability and the life of the firearm. Operating performance with attachments that affect the gas operation of the rifle are also improved. For example, silencers accumulate gas to muffle the noise. The additional dwell time allows more gas to vent to the breech, reducing load on the barrel and providing longer barrel life when silencers are employed.

While the invention has been illustrated and described in detail in the drawings and foregoing description, the same is to be considered as illustrative and not restrictive in character. All changes and modifications that come within the spirit of the invention are desired to be protected.

What is claimed is:

1. A monolithic rail platform for a firearm that includes a barrel assembly, the monolithic rail platform comprising:

a handguard portion adapted to receive at least a portion of the barrel assembly of the firearm therein;

an upper receiver portion extending rearwardly from and integrally formed with said handguard portion, said upper receiver portion adapted to receive a bolt carrier therein;

a continuous upper rail extending rearwardly along said handguard portion and said upper receiver portion; and a coupling portion at a forward end of said upper receiver portion and integral with said handguard portion, said coupling portion adapted to releasable clamp a rearward end of the barrel assembly extending through said handguard portion to said upper receiver portion, wherein said upper receiver, said handguard portion and said coupling portion are integrally unitarily constructed.

2. The platform of claim 1, wherein said upper receiver portion includes a longitudinal axis and said coupling portion includes a slot extending in the direction of said longitudinal axis separating said coupling portion into first and second clamping portions positioned on respective sides of said slot.

3. The platform of claim 2, further comprising at least one fastener positionable through said coupling portion transversely to said longitudinal axis, said at least one fastener operable to bring said clamping portions toward one another to clamp the barrel assembly in said coupling portion.

4. The platform of claim 3, further comprising a pair of fasteners positionable through said coupling portion transversely to said longitudinal axis, one of said pair of fasteners positioned against an enlarged portion of the barrel assembly to resist forward movement of the barrel assembly.

5. A monolithic rail platform for a rotating bolt type firearm that includes a barrel assembly, the monolithic rail platform comprising:

a handguard portion adapted to receive at least a portion of the barrel assembly of the rotating bolt type firearm therein;

an upper receiver portion extending rearwardly from and integrally formed with said handguard portion, said upper receiver portion adapted to receive a bolt carrier therein; and a contiguous upper rail extending rearwardly along said handguard portion and said upper receiver portion.

6. The platform of claim 5, wherein said upper rail includes a passage formed therealong for delivering gas from a forward end of the barrel.

7. A monolithic rail platform for a firearm that includes a barrel assembly and a barrel extension with a barrel extension bore, the monolithic rail platform comprising:

a handguard portion adapted to receive at least a portion of the barrel assembly of the firearm therein;

an upper receiver portion extending rearwardly from and integrally formed with said handguard portion;

a longitudinal bore extending through said upper receiver portion; and a bolt assembly movably positioned in said longitudinal bore, the bolt assembly including a bolt carrier having a protrusion at a forward end of a bolt receiving portion of the bolt carrier, the protrusion being sized for receipt in the barrel extension bore when the monolithic rail platform is part of the firearm thereby increasing a stroke length of the bolt carrier in a longitudinal bore of said upper receiver portion to increase a dwell time of a bolt by up to approximately twice that provided by bolt carriers without the protrusion, wherein a first inner diameter of the bolt receiving portion is substantially equal to a second inner diameter of the protrusion.

8. The platform of claim 7, further comprising a coupling portion at a forward end of said upper receiver portion integral with said handguard portion, said coupling portion adapted to releasably clamp a rearward end of the barrel assembly extending through said handguard portion to said upper receiver portion.

9. The platform of claim 8, wherein said upper receiver portion includes a longitudinal axis and said coupling portion includes a slot extending in the direction of said longitudinal axis separating said coupling portion into first and second clamping portions positioned on respective sides of said slot.

10. The platform of claim 9, further comprising at least one fastener positionable through said coupling portion transversely to said longitudinal axis, said at least one fastener operable to bring said clamping portions toward one another to clamp the barrel assembly in said coupling portion.

11. The platform of claim 7, wherein said handguard portion includes a number of rails extending therealong separated by recessed portions therebetween.

12. The platform of claim 11, wherein said number of rails includes a contiguous upper rail extending rearwardly along said upper receiver portion.

13. The platform of claim 7, wherein said handguard portion extends along the barrel assembly to a position adjacent a forward end of the barrel assembly.

14. The platform of claim 7, wherein the barrel assembly is attachable to said upper receiver portion and said handguard portion extends around and is separated from the barrel assembly.

15. The platform of claim 7, wherein the bolt carrier includes a forward end portion and a rearward end portion, the forward end portion including a number of lands extending therealong and spaced thereabout for contacting said upper receiver portion in said bore, said number of lands occupying from about 1% to about 12% of a surface area of the forward end portion along which the number lands extend.

16. The platform of claim 7, wherein the protrusion extends into the barrel extension for a distance of one hundred thousandths of an inch when the bolt carrier is positioned completely forwardly in said upper receiver portion.

17. A monolithic rail platform for a rotating bolt type firearm that includes a barrel assembly, the monolithic rail platform comprising:

a handguard portion adapted to receive at least a portion of the barrel assembly of the rotating bolt type firearm therein;

an upper receiver portion extending rearwardly from and integrally formed with said handguard portion;

a longitudinal bore extending through said upper receiver portion; and a bolt assembly movably positioned in said longitudinal bore, the bolt assembly including a bolt carrier including a forward end portion and a rearward end portion, the forward end portion including a number of lands extending therealong and spaced thereabout, the number of lands occupying from about 1% to about 12% of a surface area of the forward end portion along which the number of lands extend.

18. The platform of claim 17, wherein the number of lands occupy from about 1% to about 8% of the surface area of the forward end portion.

19. The platform of claim 17, wherein the number of lands occupy from about 1% to about 4% of the surface area of the forward end portion.

20. The platform of claim 17, wherein the number of lands occupy about 4% of the surface area of the forward end portion.

21. The platform of claim 17, wherein the barrel assembly includes a barrel extension at a rearward end thereof.

22. The platform of claim 17, wherein said bolt carrier includes a protrusion at a forward end thereof and a bolt receiving portion of the bolt carrier, said protrusion being sized for receipt in a barrel extension in the barrel assembly thereby increasing a stroke length of said bolt carrier in said longitudinal bore of said upper receiver portion to increase the dwell time of a belt by up to approximately twice that provided by bolt carriers without the protrusion, wherein a first inner diameter of the bolt receiving portion is substantially equal to a second inner diameter of the protrusion.

23. The platform of claim 17, further comprising a coupling portion at a forward end of said upper receiver portion and integral with said handguard portion, said coupling portion adapted to releasably clamp a rearward end of the barrel assembly extending through said handguard portion to said upper receiver portion.

24. The platform of claim 23, wherein said upper receiver portion includes a longitudinal axis and said coupling portion includes a slot extending in the direction of said longitudinal axis separating said coupling portion into first and second clamping portions positioned on respective sides of said slot.

25. The platform of claim 17, wherein said handguard portion extends along the barrel assembly to a position adjacent a forward end of the barrel assembly.

26. The platform of claim 17, wherein the barrel assembly is attachable to said upper receiver portion and extends through said handguard portion in a floating relationship therewith.

27. A monolithic rail platform for a rotating bolt type firearm that includes a barrel assembly, comprising:

a handguard portion adapted to receive at least a portion of the barrel assembly of the rotating bolt type firearm therein;

an upper receiver portion extending rearwardly from and integrally formed with said handguard portion;

a bolt carrier received in said upper receiver portion;

a longitudinal bore extending through said upper receiver portion; and a protrusion at a forward end of a bolt receiving portion of the bolt carrier, the protrusion being sized for receipt in the barrel assembly thereby increasing a stroke length of the bolt carrier in said longitudinal bore of said upper receiver portion by approximately one hundred thousandths of an inch for an rotating bolt type rifle, wherein a first inner diameter of the bolt receiving portion is substantially equal to a second inner diameter of the protrusion.

28. A monolithic platform for a firearm that includes a barrel assembly, the platform comprising:

a handguard portion adapted to receive at least a portion of the barrel assembly of the firearm therein;

an upper receiver portion extending rearwardly from and integrally formed with said handguard portion, said upper receiver portion adapted to receive a bolt carrier therein; and a coupling portion between said handguard portion and said upper receiver portion, said coupling portion including a longitudinal slot separating said coupling portion into first and second clamping portions on respective sides of said slot, wherein said first and second clamping portions are constructed and arranged such that a fastener positioned through said coupling portion transversely to said longitudinal slot is operable to bring said first and second clamping portions toward one another to clamp the barrel assembly in said coupling portion and wherein the fastener is positionable in a recess in an outer surface of the barrel assembly to resist forward movement of the barrel assembly.

29. The platform of claim 28, wherein said handguard portion is constructed and arranged so that the barrel assembly extends through said handguard portion in a floating relationship therewith when the handguard portion is clamped in said coupling portion.

30. The platform of claim 28, wherein the fastener is positionable in a recess in an outer surface of the barrell assembly to resist forward movement of the barrel assembly.

31. The platform of claim 28, further comprising a contiguous upper rail extending across said upper receiver portion and said handguard portion.

32. The platform of claim 28, wherein said handguard portion including a rail extending along the longitudinal axis of the handguard portion.

33. The platform of claim 28, wherein said upper receiver portion is constructed and arranged to receive an M16 bolt carrier therein and said upper receiver portion is constructed and arranged to receive an M16 lower receiver.

34. The platform of claim 1, wherein said coupling portion is constructed and arranged to releasably clamp a substantially smooth portion of the barrel assembly.

35. The platform of claim 4, wherein said coupling portion is constructed and arranged to releasably clamp a substantially smooth portion of the barrel assembly.

36. The platform of claim 5, further comprising a passage that provides a path for delivering gas between a gas tube coupled to the barrel assembly and the bolt carrier.

37. The platform of claim 1, further comprising a contiguous upper rail extending rearwardly along said handguard portion and said upper receiver portion.

38. The platform of claim 1, further comprising a number of rails extending along a bottom and sides of said handguard portion separated by recessed portions between said rails.

39. The platform of claim 5, wherein said handguard portion is constructed and arranged so that a forward end of the barrel assembly is positioned proximate to said handguard portion when the handguard portion is received in the handguard portion.

40. The platform of claim 5, further comprising a coupling portion at a forward end of said upper receiver portion and integral with said handguard portion, said coupling portion adapted to releasably clamp a rearward end of the barrel assembly extending through said handguard portion to said upper receiver portion.

41. The platform of claim 40, wherein said handguard portion is arranged so that the barrel assembly extends through said handguard portion in a floating relationship therewith when the handguard portion is clamped in said coupling portion.

42. The platform of claim 40, wherein said coupling portion is constructed and arranged to releasably clamp a substantially smooth portion of the barrel assembly.

43. The platform of claim 42, further comprising a passage that provides a path for delivering gas between a gas tube coupled to the barrel assembly and the bolt carrier.

44. The platform of claim 28, wherein said coupling portion is constructed and arranged to clamp a substantially smooth portion of the barrel assembly.

45. The platform of claim 8, wherein said coupling portion is constructed and arranged to releasably clamp a substantially smooth portion of the barrel assembly.

46. The platform of claim 8, wherein said upper receiver, said handguard portion and said coupling portion are integrally unitarily constructed.

47. The platform of claim 27, wherein said bolt carrier further comprises a modified cam path lengthened approximately 0.100 of an inch toward a forward end of said bolt carrier as compared to a standard bolt carrier for a rotating bolt.

48. A monolithic rail platform for a use with an M16 lower receiver and a barrel assembly, the monolithic rail comprising:

a handguard portion adapted to receive at least a portion of the barrel assembly therein;

an upper receiver portion extending rearwardly from and integrally formed with said handguard portion, wherein said upper receiver portion is constructed and arranged to receive an M16 lower receiver;

a contiguous upper rail extending across said handguard portion and said upper receiver portion.

49. The platform of claim 48, further comprising a coupling portion between said handguard portion and said upper receiver portion, said coupling portion including a longitudinal slot separating said coupling portion into first and second clamping portions on respective sides of said slot, wherein said first and second clamping portions are constructed and arranged such that a fastener positioned through said coupling portion transversely to said longitudinal slot is operable to bring said first and second clamping portions toward one another to clamp the barrel assembly in said coupling portion.

50. The platform of claim 49, wherein said upper receiver, said handguard portion and said coupling portion are integrally unitarily constructed.

51. The platform of claim 49, wherein the fastener is positionable in a recess in an outer surface of the barrel assembly to resist forward movement of the barrel assembly.

52. The platform of claim 49, wherein said coupling portion is constructed and arranged to clamp a substantially smooth portion of the barrel assembly.

53. The platform of claim 48, wherein said upper receiver portion is constructed and arranged to receive an M16 bolt carrier therein.

54. The platform of claim 17, further comprising a contiguous upper rail extending across said handguard portion and said upper receiver portion.

* * * * *

UNITED STATES PATENT AND TRADEMARK OFFICE

CERTIFICATE OF CORRECTION

PATENT NO. : 8,234,808 B2
APPLICATION NO. : 10/513254
DATED : August 7, 2012
INVENTOR(S) : Karl R. Lewis It is certified that error appears in the above-identified patent and that said Letters Patent is hereby corrected as shown below:

In column 9, line 3, please change “belt” to --bolt--
In column 11, line 9, please insert --and-- after the word “receiver;”

Signed and Sealed this
Twenty-fifth Day of September, 2012

David J. Kappos

David J. Kappos
*Director of the United States Patent and Trademark Office*